United States Patent [19]

Szabo et al.

[11] 4,320,831

[45] Mar. 23, 1982

[54] PLASTIC CONTAINERS FOR SMALL VALUABLE ARTICLES

[76] Inventors: Bela G. Szabo, 105 Park Rd., Rosslyn Farms, Carnegie, Pa. 15106; Dean J. Hirschfield, 261 Trotwood Dr., Pittsburgh, Pa. 15241

[21] Appl. No.: 165,041

[22] Filed: Jul. 1, 1980

[51] Int. Cl.[3] ..... B65D 25/54; B65D 81/00

[52] U.S. Cl. ..... 206/45.34; 206/0.82; 206/459; 206/523; 206/503; 220/345

[58] Field of Search ..... 206/45.34, 45.14, 45.19, 206/45.15, 45.22, 0.82, 0.83, 459, 523, 525, 526, 503; 220/345

[56] References Cited

U.S. PATENT DOCUMENTS

| | | | |
|---|---|---|---|
| 2,144,336 | 1/1939 | Katz | 206/45.19 |
| 2,874,828 | 2/1959 | Neugebauer | 206/45.15 |
| 3,155,236 | 11/1964 | Reno | 206/0.82 |
| 3,191,766 | 6/1965 | Gillam | 206/45.22 |
| 3,406,821 | 10/1968 | Weissberg | 206/526 |
| 4,033,452 | 7/1977 | Therrien | 206/0.83 |
| 4,275,810 | 6/1981 | Waldmeier | 206/45.34 |

*Primary Examiner*—William T. Dixson, Jr.
*Attorney, Agent, or Firm*—Samuel Lebowitz

[57] ABSTRACT

A container of molded plastic material for storing, shipping or displaying precious gems, coins or other small valuable articles which require special handling. The container is comprised of three separate components,—a base providing a seat or storage receptacle for one or more of the articles, a rockable cover therefor, and a latch for locking the cover in its closed position. The cover may be fused to the base in the latter position if an additional factor of safety is desired to prevent tampering with the articles in the course of transit. A portion of the base may be used for bearing indicia and advertising matter relevant to the articles. The completely detachable rockable cover for the articles may function additionally as an inclined support for the container in display position, and the latch may assume the form of a completely detachable slide cooperating with a finger tab on the cover on the end of the container opposite the rocking axis of the cover, to conceal the tab and thereby to prevent the opening movement of the cover. Cooperating projections and depressions on the top and bottom of the container, respectively, permit convenient and reliable stacking and maintenance of the containers in proper alignment in a shipping or portable sample case.

20 Claims, 10 Drawing Figures

Fig. 4
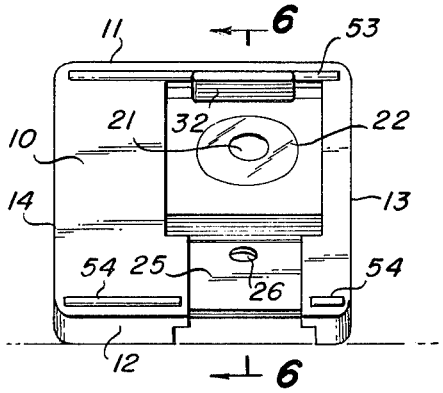
Fig. 5
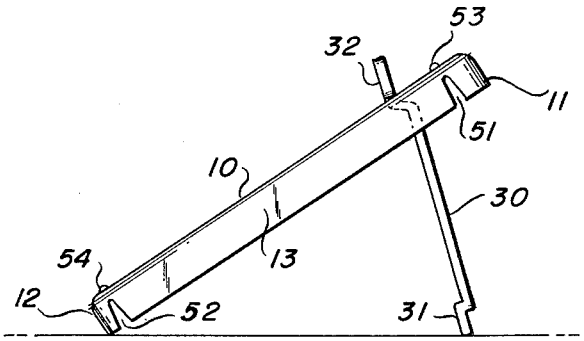
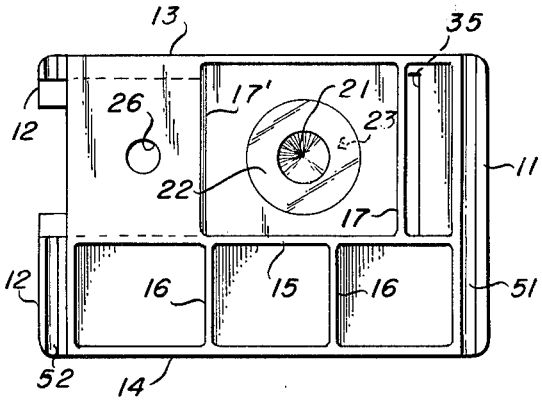
Fig. 6
Fig. 7
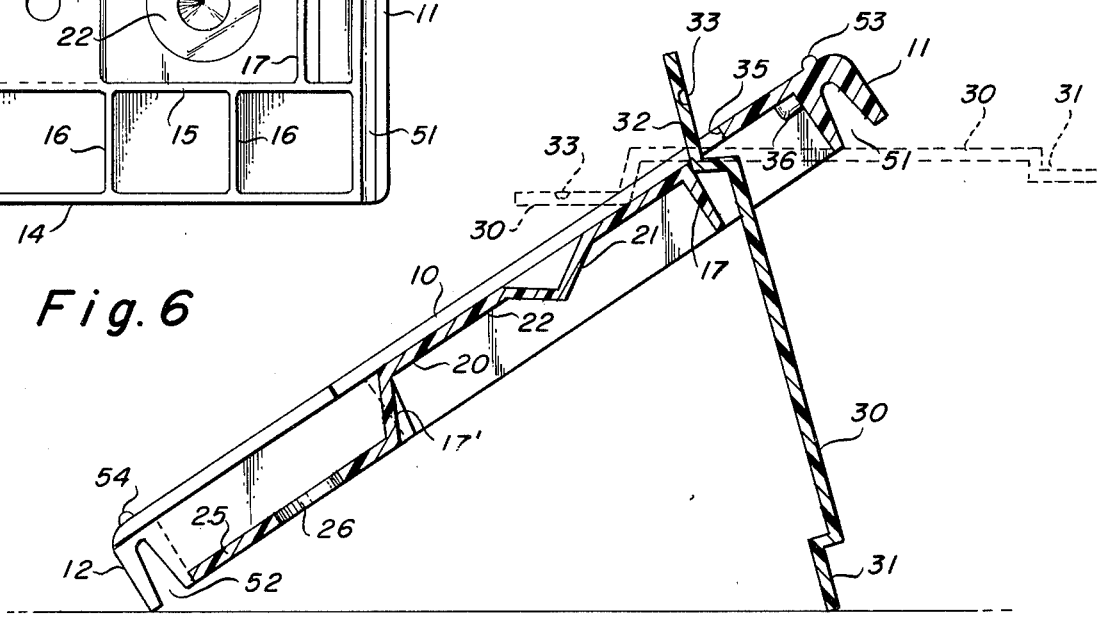
Fig. 8
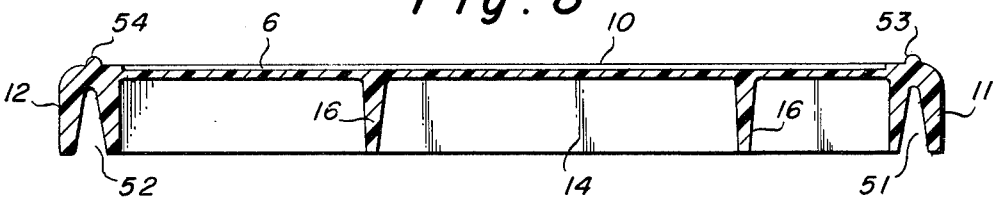

PLASTIC CONTAINERS FOR SMALL VALUABLE ARTICLES

This invention relates to a receptacle of molded plastic material which may serve for the storage, shipping and display of small valuable items such as precious gems, coins or the like.

It is the object of the present invention to provide an attractive container for small valuable articles and particularly precious gems, which may be viewed in either the closed or open position of the container, while maintaining a high degree of security against loss or theft in the course of transit, display or examination by purchasers.

It is another object of the invention to provide a container of molded plastic material comprised of only three components which are capable of being molded and assembled efficiently and economically so that the housing, shipping and display of the individual items may be simplified without sacrifice of safety and reliability on the handling of the articles.

The invention contemplates the utilization of the main component and base of the assembly as a repository for the articles, with clear and reliable identification thereof by either permanent or interchangeable indicia relevant thereto. A pivoted cover for the base and the articles is molded separately and may function as a temporary or permanent cover for the valuable articles. In an alternative position the cover may also serve as an inclined support for the display of the latter. A third component consists of a locking slide or latch for the cover to secure the retention of the cover against accidental displacement and possible loss of the articles enclosed in the assembly.

The assembly may be provided with indexing means to facilitate the stacking of adjacent units so that an easy control thereof may be had either in the course of shipment or display.

It is the object of the invention to improve upon small display containers molded of relatively rigid synthetic plastic materials, such as high impact polystyrene, as disclosed in U.S. Pat. Nos. 3,348,724, Oct. 24, 1967; 3,524,541, Aug. 18, 1970; 3,530,978, Sept. 29, 1970; and 4,033,452, July 5, 1977.

Other objects and purposes will appear from the detailed description of the invention following hereinafter, taken in conjunction with the accompanying drawings, wherein FIG. 1 is a perspective view of the molded plastic container in accordance with the present invention;

FIG. 4 is a front elevation of the container shown in FIGS. 1 and 2, in an inclined position for effective display, which position is maintained by the adjustable cover;

FIG. 5 is a right end view of FIG. 4;

FIG. 6 is a bottom view of the base of the container shown in FIGS. 1 and 2;

FIG. 7 is an enlarged vertical sectional view along line 6—6 of FIG. 4 with the cover positioned for closing indicated in dotted lines;

FIG. 8 is a vertical sectional view along line 8—8 of FIG. 1;

Figure 1:
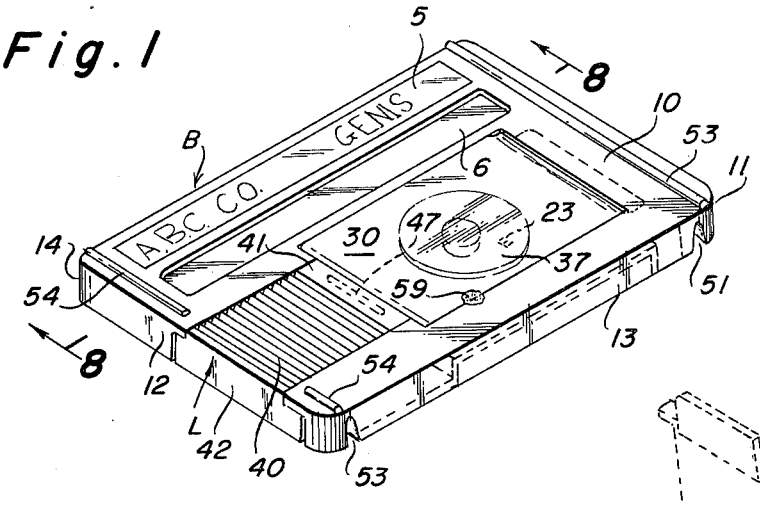

In the drawings is shown an attractive container for small valuable articles, which in the illustrated embodiments may be precious gems such as diamonds, uncut gems, valuable coins, gold nuggets, fragile or sensitive electronic units, etc. The container may be molded of three components of relatively rigid plastic material, which simplifies the molding as well as the assembly thereof to attain a rugged and economical construction while using a minimum amount of plastic material.

The principal component consists of a substantially rectangular base B having an upper wall 10 from the perimeter of which, opposite end walls 11 and 12 and lateral walls 13 and 14 extend downwardly. This base is reenforced by a wall 15 extending longitudinally between the end walls 11 and 12 and a pair of spaced walls 16 extending transversely between walls 14 and 15 and walls 17,17' extending transversely between walls 13 and 15. A depressed panel 6 on the upper face of the base may receive indicia strips relevant to the article, while the companion panel 5 adjacent the wall 14 may be utilized for advertising the product by the provision of detachable strips or permanent embossments.

The reenforcing wall 17 on the bottom is adjacent a slot 35 extending through the base between the walls 15 and 13. This slot serves as an end boundary of a depressed storage portion 20 below the plane of the upper wall 10 and extends as far as the transverse wall 17' therebelow, whereat it drops further to form the lowered web 25 which is in the same horizontal plane as the bottom of the base. The slot 35 forms the seat of engagement of the cover 30, which is of generally planar form for the major part of its length, having a depressed flange 31 at one end thereof and a depressed finger tab 32 at the opposite end thereof, as clearly shown in FIG. 7.

The depressed storage portion 20 of rectangular outline, may be molded of any suitable synthetic plastic material as is the rest of the assembly, with selective areas of transparency and translucency attained in a manner well known in the art. The central portion 22 is transparent and includes a frusto-conical portion 21 which may seat the pavilion of a gem. A code designation 23, for example, E, may be embossed in the annular portion 22 to identify the size of the gem or to impart any other information relative thereto.

Figure 2:
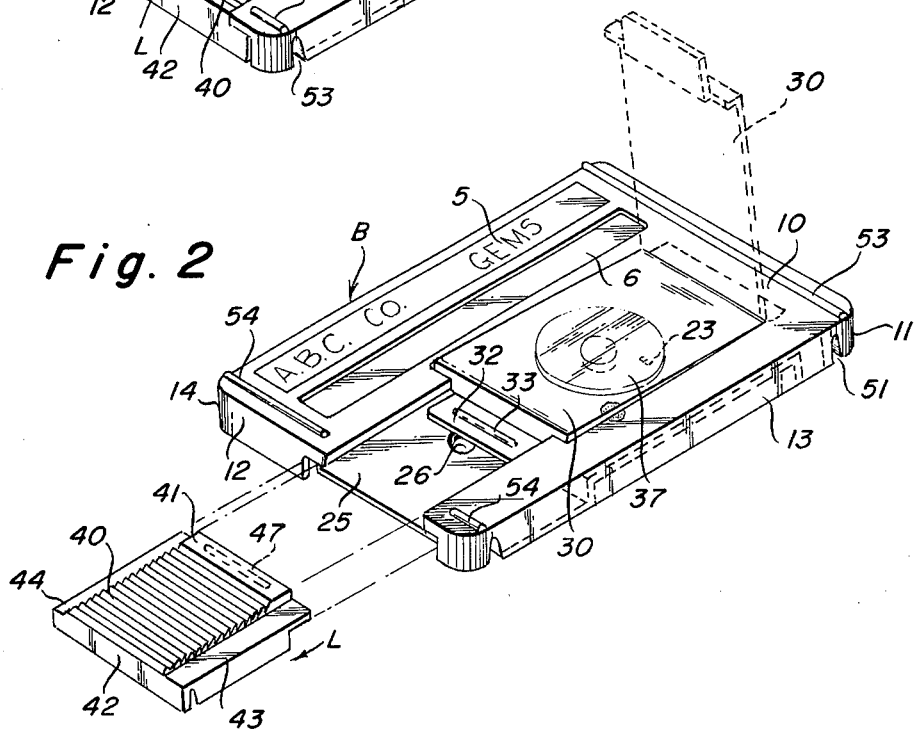
FIG. 2 is a perspective view similar to FIG. 1 showing the locking slide in an inoperative position, which permits the cover of the container to be raised, as shown in dotted lines.

The cover 30 may be lifted from the base at various angles, as indicated in FIG. 2, and it may be passed through the slot 35 in either direction for either the covering function or complete withdrawal from the base, as indicated in dotted lines in FIG. 7, or for partial withdrawal in the reverse direction to engage the slot at the junction of the inner edge of the finger tab with the main portion of the cover as shown in solid lines in FIG. 7, so that the cover may serve as a support for the base in inclined position for display purposes. This pivotal capability presents a simplification of a hinge construction, resulting in economies in molding, assembly and durability of the device, by eliminating the possibilities of hinge failures.

Figure 3:
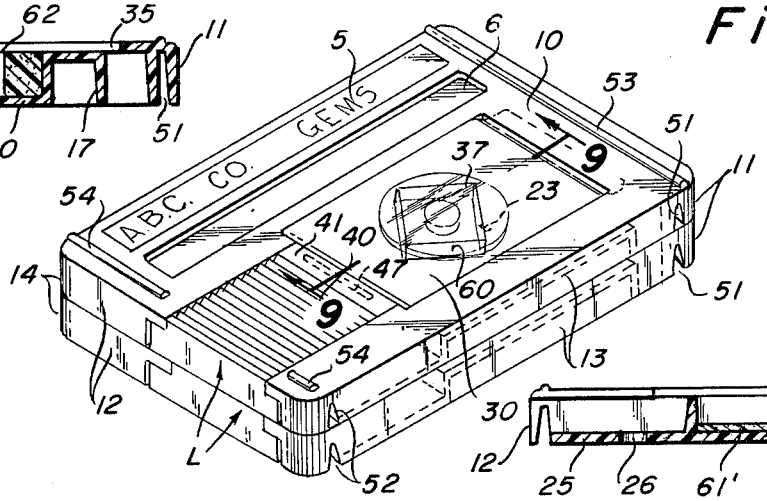
FIG. 3 is a perspective view of a plurality of stacked containers of a slightly different design from that shown in FIGS. 1 and 2.

The extension of the cover through the slot into overlying relation with the depressed storage portion 20 from the position shown in dotted lines in FIG. 7 to that shown in FIGS. 1 to 3, serves to cover the portion 20 and the gem seated thereon and brings the finger tab 32 in overlying relation with the inner portion of lowered web 25. The finger tab may now be locked to prevent the lifting of the cover by the reciprocable latching slide L having lateral slide tracks 43,44 cooperating with the lateral guide walls above the edges of the depressed web. The outer end 42 of the slide is manipulated to bring the inner end 41 in overlying relation with the finger tab 32 to prevent the raising of the cover when the slide L is in its inner position shown in FIG. 1. An opening 26 in the web 25 in the area of the end of tab 32 permits the insertion of a tool from the underside of the base in the event any jamming or sticking arises in the movement of either the slide or finger tab.

An elongated ridge 47 on the bottom surface of the advancing edge of the slide cooperates with a molded elongated groove in the upper face of the finger tap 32 to interlock with each other and thereby enhance the engagement between elements 32 and 41. In view of the fact that the slide action of the latch L and the walls above the web 25 is a tight one, the upper surface 40 of this slide may be serrated to facilitate the engagement of an operator's finger or nail therewith.

The overlapping of the superposed portions of the slide and finger tab and the cooperating elements 47 and 33 may be biased slightly so that the withdrawal of the former causes a slight upward springing of the finger tab 42 to facilitate the initiation of a pivotal movement of the cover. The retention of the parts in place for either the normal positioning of the cover 30 in overlying relation to the depressed storage portion 20 or the pivotal lifting of the cover, is facilitated by the provision of reenforcing lugs 36 at the junction of walls 10 and 11.

In order that the gem may be viewed while the cover is in a closed or locked position, the central portion 37 thereof is likewise transparent. The circular dimension of this portion coincides with the size of the annular area 22 in the storage portion to permit the sighting of the code indicia 23 as well.

In order to permit an orderly stacking of a plurality of containers in accordance with the invention, ridges 53 and 54 are molded in the upper face of the base adjacent to the end walls 11 and 12, respectively, which interengage with grooves 51 and 52 in the bottom edges of the end walls 11 and 12 of an overlying container, as shown in FIGS. 3 and 8.

The security of the contents in the plastic containers of the invention may be enhanced by sealing the covers to the base by coalescing the two components with plastic solvents as indicated at 59 in FIG. 1. These integrated connections may be in the form of spots, as shown, or along areas of greater extent. The adoption of this expedient requires destruction of the container at the point of use to permit access to the protected article.

Figure 9:
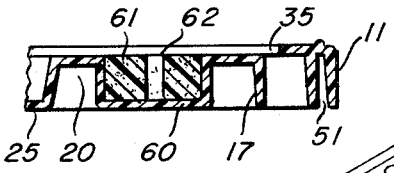
FIG. 9 is a vertical sectional view along line 9—9 of FIG. 3.

The storage area 20 of the base is capable of modification in order to house valuable articles of many different types. The contours and areas of the seats and housings molded in this area are adapted to the special needs and objectives which are sought to be attained. Thus, as shown in FIGS. 3 and 9, the storage portion 20 is molded with a depressed receptacle 60 of rectangular contour, the top of which is visible through the transparent portion 37 of the cover 30 (FIG. 3). This rectangular receptacle which may be as deep as the base, may accommodate an insert 61 of sponge rubber. The latter may be of varying depth and may be provided with a central aperture 62 to seat therein a gem similar to the gem housed in the containers according to the embodiment described above. The rectangular receptacle with its removable cushioning insert, may also accommodate gems of larger size, as well as those having shapes other than round, such as marquise, pear, heart, emerald cut, etc.

Also, a storage receptacle of the type shown in FIG. 9 is capable of housing a plurality of gems if the display function thereof is not important.

Figure 10:
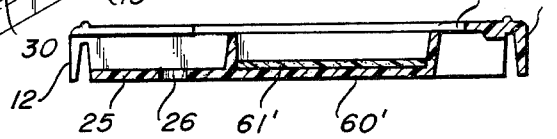
FIG. 10 is a vertical sectional view similar to FIG. 9, of another embodiment of the invention.

In the embodiment shown in FIG. 10, the receptacle 60' molded in the storage portion of the base is substantially coextensive with the latter. A thin pad 61' of foam resin may support a plurality of gems, delicate semiconductor chips, one or more valuable coins, etc.

The storage portion of the base may be molded in many other forms besides those shown in the drawings and described above. Thus, this portion may be subdivided into a plurality of relatively large receptacles of the type shown in FIGS. 3 and 9, or if desired, the bottom of the entire storage portion may be subdivided into a plurality of semi-spherical concavities or conical depressions of the type shown in FIG. 7.

The molded containers with their contents are adapted to be boxed in multiple units, for example, in packs of ten and twenty, or twelve and twenty-four. The containers interlock with each other by virtue of the indexing elements 51–54.

We claim:

1. A combined storage, shipping and display container of molded plastic material for holding at least one valuable article of small size, comprising (a) a unitary base formed of a top with a plurality of integrally molded intersecting vertical wall portions, (b) said top having a depressed storage portion within the confines of said base, (c) said storage portion having a generally rectangular outline with an elongated slot at one end thereof, (d) a lowered web at the opposite end of said storage portion in the lowermost plane of said base, (e) a receptacle for said article in said storage portion, (f) a detachable rockable cover for said storage portion having a terminal flange engageable within said slot to permit the alternative disposition of said cover in overlying relation to said storage portion or in varying planes at different angles with respect to the latter, (g) a depressed finger tab on the free end of said cover opposite said terminal flange and overlying the inner end of said lowered web, and (h) a locking member movable over said web for selective engagement over the top of said finger tab for preventing the rocking movement of said cover.

2. A device as set forth in claim 1 wherein said receptacle is of conical contour to accommodate the pavilion of a precious gem.

3. A device as set forth in claim 2 wherein said receptacle and a limited circular area of the storage portion adjacent thereto are transparent while the remaining area of the storage portion is translucent.

4. A device as set forth in claim 3 wherein said circular area bears an indicia marking relevant to the article seated in said receptacle.

5. A device as set forth in claim 3, wherein the main portion of said detachable cover is translucent and the central portion thereof is transparent.

6. A device as set forth in claim 5 wherein the central transparent portion of the cover is circular and is substantially coextensive with the transparent circular area of the storage portion.

7. A device as set forth in claim 1 wherein the outer end of said finger tab is yieldable and is adapted to be pressed towards said web by the inner end of said locking member, which upon withdrawal from said finger tab effects a partial lifting of said cover.

8. A device as set forth in claim 7 wherein said web is provided with an opening permitting access to said locking member and finger tab from the underside of said web.

9. A device as set forth in claim 7, including a cooperative projection and depression in the overlying portions of the inner end of the locking member and finger tab, respectively.

10. A device as set forth in claim 1, wherein said locking member is a reciprocable slide, a pair of guide walls on said base above the opposite lateral edges of said web, and corresponding cooperating slide tracks on the lateral edges of said locking slide.

11. A device as set forth in claim 10, including a serrated portion on the upper surface of said locking slide between said slide tracks for facilitating the manipulation of said locking slide.

12. A device as set forth in claim 1, wherein the engagement of the terminal flange of said cover within the slot is of sufficient looseness to permit the lifting of the cover from the storage portion to desirable angles and optionally to project the flanged end of said cover through the base to dispose it in position to function as an inclined supporting back for the container in an inclined display position.

13. A device as set forth in claim 1, wherein said container is of rectangular contour, with ribs extending from the top thereof along the opposite edges at the ends thereof, and grooves at the bottom of said opposite edges of said ends below said ribs for receiving the ribs of a subadjacent container.

14. A device as set forth in claim 1, wherein said base is of rectangular contour with the storage and web portions constituting the major area thereof.

15. A device as set forth in claim 14, including a depressed panel extending across the top for receiving a record bearer for indicia relevant to the article.

16. A device as set forth in claim 15, including an additional panel for receiving advertising indicia.

17. A device as set forth in claim 1, wherein the cover in overlying relation to said depressed storage portion forms a smooth continuum of the integral top along the edges of the cover, which edges are adapted to be coalesced to the top by a solvent for the molded plastic material, to seal permanently the contents of the container.

18. A device as set forth in claim 1 wherein said receptacle is of polygonal outline and of substantially the same depth as said vertical wall portions.

19. A device as set forth in claim 18, including a foam insert in said receptacle to provide a cushioned article support.

20. A device as set forth in claim 18 wherein said receptacle is of rectangular outline and substantially coextensive with said storage portion.

* * * * *